United States Patent [19]

Langford

[11] 4,065,322

[45] Dec. 27, 1977

[54] CONTAMINATION REMOVAL METHOD

[75] Inventor: John R. F. Langford, West Chester, Ohio

[73] Assignee: General Electric Company, Cincinnati, Ohio

[21] Appl. No.: 660,619

[22] Filed: Feb. 23, 1976

[51] Int. Cl.[2] ..... B08B 7/00

[52] U.S. Cl. ..... 134/7; 134/8; 134/20; 134/39; 51/320

[58] Field of Search ..... 134/7, 19, 23, 8, 20, 134/39; 51/320, 321

[56] References Cited

U.S. PATENT DOCUMENTS 3,033,711 5/1962 Harding ..... 134/7

*Primary Examiner*—Arthur D. Kellogg

*Attorney, Agent, or Firm*—Henry J. Policinski; Derek P. Lawrence

[57] ABSTRACT

A method of removing contaminants from the surface of an article is comprised of the steps of providing abrasive particles comprised of a material having the characteristic of reacting with oxygen to form predominately gaseous products of reaction and directing the abrasive particles in impingement onto the contaminated surface. The method is particularly applicable in removing contaminants from the internal components of air-breathing machines such as gas turbine engines. The abrasive particles may be entrained in an air stream flowing through the gas turbine engine whereby the particles are directed in impingement against the contaminated components. The abrasive particles may be comprised by carbon content of at least 70% by weight and a volatile content of less than 8% by weight and may also have an erosivity within the range of 0.004 grams to 0.15 grams.

37 Claims, 1 Drawing Figure

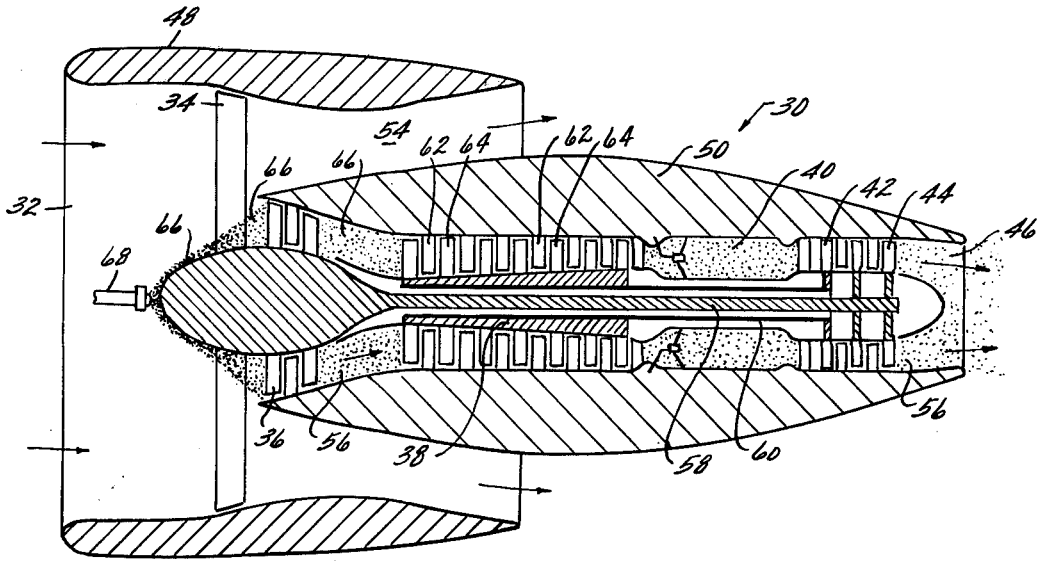
48
34
54
62
64
62
64
30
50
40
42
44
46
66
66
66
32
68
36
56
38
58
60
56

CONTAMINATION REMOVAL METHOD

BACKGROUND OF THE INVENTION

This invention relates to a method of removing contaminants from the surface of an article and, more particularly, a method of removing contaminants from the internal components of an air-breathing machine such as an aircraft gas turbine engine. The invention finds specific application in the removal of contaminants from vanes and blades associated with the compressor of an aircraft gas turbine engine of the high by-pass fan type.

In a high by-pass fan type gas turbine engine, a compressor supplies air under pressure to a combustion chamber in which fuel is mixed with the pressurized air and the mixture burned. The hot products of combustion are passed sequentially through a pair of turbines, the first of which extracts kinetic energy from the expanding hot gases to power the compressor and the second of which extracts additional kinetic energy from the hot gases to power a fan adapted to generate the major portion of the thrust associated with the engine. After passing through the second turbine the hot gases are expelled from the engine, thereby generating the remaining portion of the thrust associated with the engine.

The overall efficiency of the gas turbine engine is heavily dependent upon the efficiency of the compressor. The pressure ratio of the compressor, that is to say the ratio of air pressure at the compressor outlet to air pressure at compressor inlet, is one of the significant parameters which determines the operating efficiency of the compressor. The higher the pressure ratio at a given compressor rotational speed, the greater the efficiency. The higher the air pressure at the outlet of the compressor, the greater the energy available to drive the turbines downstream of the compressor and hence to provide thrust generation by the engine.

In axial flow compressors, pressurization of air is accomplished in a multiplicity of compressor stages or sections, each stage being comprised of a rotating multi-bladed rotor and a nonrotating multi-vaned stator. Within each stage the airflow is accelerated by the rotor blades and decelerated by the stator vanes with a resulting rise in pressure. Each blade and vane has a precisely defined airfoil surface configuration or shape whereby the air flowing over the blade or vane is accelerated or decelerated respectively. The degree of air pressurization achieved across each blade-vane stage is directly and significantly related to the aforementioned precise airfoil surface shape.

It has been found that, in service, the surfaces of the compressor blades and vanes become coated with contaminants of various types. Oil and dirt from airfield runways have been found adhered to the blade and vane surfaces. Aluminum and other metal substances erode from the other portions, such as clearance seals, of the engine and are deposited on the blades and vanes. These surface contaminants alter the above-mentioned precise airfoil surface shape, disturbing the desired airflow over the blades and vanes and cause reduced pressure rises across the various compressor stages and hence a drop in compressor efficiency. Typically, the drop in efficiency results in reduced thrust output for a given engine speed. While thrust levels can be maintained by operating the engine at overspeed conditions, such operation results in increased engine maintenance and reduced engine life.

Removal of the aforedescribed contaminants from blades and vanes of in-service compressors is desirable to restore compressor and engine efficiency. Since it is both time-consuming and expensive to disassemble the engine from the aircraft and thence the compressor from the engine, it is also desirable to remove the aforedescribed contaminants while the engine is on-wing. Furthermore, any method utilized to remove the contaminants must not interfere with the structural or metallurgical integrity of other components of the engine. By way of example, an acceptable method must remove aluminum contaminants adhering to the blades and vanes of the compressor without deleteriously affecting other aluminum components of the engine. In this regard, it is known in the art that contaminants can be removed from the internal components of a gas turbine engine by ingesting, into the engine inlet at idle speed, substances generally characterized as liquid solvents. However, liquid solvents, because of their dispersive characteristics, chemically attack not only the contaminants but also other portions of the engine which are made of the same material as the contaminants. Hence, where contamination of the vanes and blades has resulted from material erosion of other engine components, the ingestion of liquid solvents into the engine has not proven to be an acceptable method of removing the contaminants.

Another known method of removing contaminants from the internal components of a gas turbine engine utilizes solid particle abrasives which are ingested into the engine at idle speeds. The abrasive particles impinge upon the contaminated surfaces dislodging the contaminants. However, materials used in the prior art as abrasives have proven to be unsatisfactory. More particularly, these abrasives have been found to be overly abrasive such that they not only dislodge the contaminants but also destroy the surface smoothness of the blade or vane. Furthermore, it is generally accepted that while most of the abrasive material will be ejected from the engine through the exhaust, some of the abrasive will remain in the engine. Prior art abrasives have either been noncombustible in which case the particles clog cooling holes of the turbine components and restrict needed cooling air flow or the abrasives are combustible but leave residue deposits which also clog turbine component cooling holes.

Applicant's novel invention addresses these and other insufficiencies associated with prior art methods by providing a new and useful method which includes the use of a material, the abrasive characteristics of which have been hitherto unrecognized and unapplied in the removal of contaminants.

Therefore, it is an object of the present invention to provide a method for removing contaminants from the surface of an article.

It is another object of the present invention to provide a method for removing contaminants from the internal components of an air-breathing machine such as a gas turbine engine and, more particularly, for removing contaminants from stator vanes and rotor blades associated with the compressor of such an engine.

It is still another object of the present invention to provide a method of removing contaminants from compressor stator vanes and rotor blades without deleteriously affecting the structural or metallurgical integrity of other portions of the gas turbine engine.

It is still another object of the present invention to provide a method of removing contaminants from compressor stator and rotor vanes wherein such method includes injecting an abrasive material into the engine inlet while the engine is operating at idle speed.

It is yet another object of the present invention to provide a method of removing contaminants from compressor rotor and stator blades wherein an abrasive material injected into a gas turbine engine will not, if burned in the hot sections of the engine, leave a residue sufficient to interfere with the proper operation of the engine.

SUMMARY OF THE INVENTION

Briefly, these and other objects which will become apparent from the following specification and appended drawing are accomplished by the present invention which provides a method for removing contaminants from the surface of an article wherein abrasive particles are provided which are comprised of a material having the characteristic of reacting with oxygen to form a predominantly gaseous product of reaction. The particles are directed in impingement onto the contaminated surface. The abrasive particles may have an erosivity within the range of 0.004 grams to 0.15 grams and may be comprised of a carbon content of at least 70% and a volatile matter content of less than 8%. The method may further include the step of entraining the abrasive particles in a fluid flow stream and directing the fluid flow stream in impingement onto the contaminated surface. The method, in one form of the invention, includes removing contaminants from the internal components of an air-breathing machine such as a gas turbine engine by impinging by-product coke having a carbon content of at least 80% by weight, and a volatile matter content of less than 6% by weight upon the contaminated internal components.

DESCRIPTION OF THE DRAWING

While the specification concludes with claims distinctly claiming and particularly pointing out the invention described herein, it is believed that the invention will be more readily understood by reference to the discussion below and the accompanying drawing in which:

FIG. 1 is a schematic cross-sectional drawing of a gas turbine engine in which the method of the present invention is utilized.

DESCRIPTION OF THE PREFERRED EMBODIMENT

Referring now to FIG. 1, a schematic view depicting an airbreathing gas turbine engine is shown generally at 30 for the purpose of illustrating an application of the novel method comprising the present invention. Engine 30 is comprised of inlet 32, fan 34, booster 36, compressor 38, combustor 40, high pressure turbine 42, low pressure turbine 44 and exhaust 46 arranged in a serial flow relationship. Fan 34 is surrounded by circumferentially and axially extending fan shroud 48 while booster 36, compressor 38, combustor 40, high pressure turbine 42, low pressure turbine 44 and exhaust 46 are enclosed in circumferentially and axially extending engine cowl 50. Fan shroud 48 is disposed so as to overlap the upstream end of engine cowl 50 forming, in cooperation therewith, an annular by-pass duct 54 through which air propelled by fan 34 is exhausted. An annular flowpath 56 is provided radially inward of by-pass duct 54 and extends the axial length of engine 30. Booster 36, compressor 38, combustor 40, high pressure turbine 42, low pressure turbine 44 and exhaust 46 are each disposed sequentially within flowpath 56.

Fan 34 and booster 36 are driven by low pressure turbine 44 through shaft 58 which extends forward from the aft-located low pressure turbine. Compressor 38 is powered by high pressure turbine 42 through hollow drive shaft 60 disposed coaxially and concentrically with drive shaft 58. Ambient air drawn into inlet 32 is propelled aftward by fan 34. A portion of the air is propelled through by-pass duct 54 to provide the majority of the thrust generated by engine 30. The remaining air enters annular flowpath 56 where it is initially pressurized by booster 36, further pressurized by compressor 38 and mixed with fuel and burned in combustor 40. The hot gases resulting from the combustion process are expelled from the combustor 40 through high pressure turbine 42 which extracts kinetic energy from the hot gases. Energy extracted by the high pressure turbine is utilized to drive the compressor 38. The hot gases of combustion are then received by the low pressure turbine whereby additional energy is extracted for powering fan 34 and booster 36. The hot gases are thence expelled from the engine through exhaust 46 whereby the kinetic energy remaining therein provides further thrust generation by engine 30.

Compressor 38 is comprised of a series of stages disposed axially adjacent with respect to each other. Each stage is comprised of a plurality of circumferentially disposed stationary stator vanes 62 affixed to the compressor housing positioned axially adjacent to a plurality of circumferentially disposed rotating rotor blades 64 rigidly connected to rotating drive shaft 60. Stator vanes 62 and rotor blades 64 have precisely defined airfoil surface configurations or shapes with impart kinetic energy to the airflow through the compressor. Airfoil surface shape is critical in achieving optimal pressurization of the air. If the airfoil surface shape is not aerodynamically efficient, the air flowing over the airfoil surfaces will not be accelerated nor pressurized to the degree necessary for optimum compressor efficiency. In service, contaminants, which either enter the engine from the environment or are present as products of erosion from engine components, can adhere to the compressor stator vanes 62 and rotor blades 64. These contaminants alter the aerodynamic characteristics of the airfoil surfaces and result in reduced compressor efficiency.

The present invention provides a new and novel method of removing contaminants from the airfoil surfaces of the vanes 62 and blades 64. The invention embraces imparting kinetic energy to solid abrasive particles and directing the particles in impingement onto the contaminated surface whereby the contaminants are dislodged. Referring again to FIG. 1, a jet nozzle 68 is disposed in near proximity to engine inlet 32 and discharges abrasive particles 66 into the airstream flowing through inlet 32 while the engine is operating under idle conditions. Particles 68 are entrained in the airstream and are propelled by fan 34 in the aft direction. While some of the abrasive particles are ejected from the engine through by-pass duct 54, the remaining particles enter flow passage 56. As the airstream flows in the aft direction, the particles 66 entrained therein impinge directly upon the vanes and blades in successive stages of the compressor 38 dislodging contaminants adhered thereto. It should be noted that the velocity of the air flowing through passage 56 is quite substantial such that particles 66 striking the airfoil surfaces have substantial kinetic energy. While some kinetic energy will be lost by the particles as a result of the collision with the airfoil surface and as a result of performing net work in dislodging the contaminants, the moving airstream will quickly restore some, if not all, of the kinetic energy prior to collision of the particles 66 with the next successively adjacent downstream airfoil. Hence, the abrasive particles are effective to remove contaminants not only from the airfoils disposed at the upstream end of the compressor but also those disposed at the downstream end.

Abrasives known in the prior art have not proven to be suitable for use in the removal of contaminants associated with air-breathing gas turbine engines. The prior art abrasives are too hard resulting in pitting, scoring and other distortion of the airfoil surfaces. Furthermore, some of these abrasives burn in the hot sections of the engine and leave a residue which clogs cooling passages and otherwise interferes with the proper operation of the engine while others, which are noncombustible, lodge in the cooling holes of the turbine components of the engine and restrict needed cooling air flow.

The novel method of the present invention includes the use of materials which overcome these shortcomings. Principally, the present invention contemplates the use of abrasive particles comprised of a material which, if subjected to the temperature in the hot sections of the engine for a sufficient residence time, will oxidize and produce a product of reaction which is predominantly gaseous, rather than solid, leaving little or no undesirable residue. Consequently, the cooling holes of the turbine components of the engine remain free of residue and the necessary cooling operation can occur without impairment.

It has been discovered that materials comprised substantially of carbon will, when oxidized in the presence of sufficient oxygen, produce substantially a gaseous product, namely carbon dioxide, without producing a residue sufficient to clog the cooling holes of the turbine components. Materials comprised of carbon in amounts above 70% by weight and preferably in the range of 75% to 98% by weight will not, if oxidized, leave residues in amounts sufficient to interfere with the operation of the internal component of a gas turbine engine. Furthermore, these materials exhibit abrasive qualities particularly well adaptable for removal of contaminants from the internal components of gas turbine engines. Specifically, these materials exhibit erosivity levels within the range of 0.004 grams to 0.15 grams, as measured in a manner hereinafter to be described, and are suitable abrasives for use in the subject method.

Another feature of these types of carbon materials which prescribes their use is their fracture characteristics. Upon impact with the vanes and blades of the compressor some of the kinetic energy held by the carbon particles is dissipated through fracture of the particle. Furthermore, the carbon particle will fracture into a plurality of jagged pieces, each of which possess generally the same abrasive surface roughness characteristics as its parent. Since the abrasive characteristics of the particle are retained in each piece, removal of contamination from downstream vanes and blades is enhanced.

The aforementioned erosivity is a measurement of the abrasivity of the particles measured under carefully controlled conditions. Specifically, erosivity is the amount of material, expressed in grams, eroded from a titanium plate by impingement of a stream of abrasive particles thereon. The controlled conditions under which erosivity is measured are as follows. The abrasive particles are ejected from a 0.188 inch diameter nozzle which is pressurized by air at 40 p.s.i. and disposed at an angle of 15° with a target plate made of a titanium based alloy consisting, nominally by weight, of 6 Al, 2 Sn, 4 Zr, 2 Mo, with a balance essentially Ti, commercially known as Ti-6-2-4-2. The nozzle is disposed a distance of 4 inches from the plate as measured along the 15° angle. The target plate is 2 inches in length, 1 inch in width and 0.080 inches thick. The abrasive particles are ejected from the nozzle in impingement on the 2 square inch target surface for a period of 75 seconds. The difference between the weight of the target plate before and after impingement by the abrasive is defined as erosivity and is expressed in grams. The greater the weight difference (erosivity) the greater the abrasive characteristics of the abrasive.

By-product coke produced from distillation of coal or petroleum has been found to be a particularly suitable carbon material for use as an abrasive for application in the subject method. Typically, by-product coke will be comprised of approximately 80% to 95% carbon and less than 8% volatile matter and preferably within the range of 1% to 6% volatile matter. Volatile matter is those products which evolve in the presence of heat applied during decomposition of material. By way of example, in the carbonization of coal, the complex coal substance, in the presence of heat, is broken down causing the evolution of condensible tars and oils (volatile products) and leaving coke. The percent of volatiles remaining in the coke will depend upon the degree of carbonization of the coal, that is to say, the temperature applied to the coal. The greater the carbonization of the coal, the less volatile matter remaining in the coke and hence the less volatile material available to contaminate the internal components of the gas turbine engine when the coke is oxidized therein. The erosivity of by-product coke is approximately 0.044 grams as measured in accordance with the procedure previously described. Coke crushed to a particle size such that it will pass through a Size 6 Sieve on the U.S. Standard Screen Scale has been particularly effective for cleaning the internal components of a gas turbine engine.

Coke particles 66 ingested into the engine inlet 32 are entrained in the air flow stream and impinge upon the stator vanes 62 and rotor blades 64 of the first stage of the compressor 38. As a result of the collision, contamination is removed from the airfoils and the coke particles 66 fracture into similarly abrasive smaller pieces which then are carried by the air flow stream into impingement upon the blades 64 and vanes 62 of the next downstream stage of the compressor 38 removing contaminants therefrom. This sequence occurs at each successive downstream stage whereby all the blades 64 and vanes 62 of the compressor 38 are decontaminated.

The major portion of the coke particles 66 emerging from the compressor 38 is carried by the flowing air stream through the hot section of engine 30, sequentially comprised of combuster 40, high pressure turbine 42, low pressure turbine 44, and out of the engine 30 through the exhaust 46. The majority of the coke particles 66 will not burn in the hot section since the stream of air flows through the engine at a high velocity and therefore the residence time of the coke particles 66 in this section is insufficient for oxidation to occur. Some of the coke particles 66, however, will remain in the hot section of the engine 30 being deposited in various portions of the hot section as, by way of example, in cooling passages of the blades and vanes of turbines 42 and 44. Coke particles 66 remaining in the hot section of engine 30 are exposed to the high temperatures in the hot section and, in a short time, will accumulate a sufficient residence period in the hot section for oxidation of the particles to occur. The coke particles 66 will then completely oxidize producing, as a predominant product of reaction, carbon dioxide gas which is immediately carried out of the engine 30 by the air flow stream. The solid residue, if any, remaining will not be sufficient to interfere with cooling of the turbines 42 and 44 or with the operation of other components of engine 30.

By combining selected quantities of carbon particles of a number of specific mesh sizes, polishing the vanes and blades can be accomplished in addition to removal of the contaminants. The larger particles having larger mass and hence more momentum serve to dislodge the contaminants from the surface of the airfoil. The smaller fine particles serve to lightly smooth and polish the surface of the airfoil. Polishing alone may be accomplished only by ingesting particles in the smaller mesh ranges.

While the preferred embodiment of my invention has been described fully in order to fully explain its principles, it is understood that various modifications or alterations may be made therein without departing from the scope of the invention as set forth in the appended claims. As an example, the method set forth in the claims is useful in removing any undesirable materials or condition from the surface of an article. Hence, it is understood that the word "contaminants" as used in the appended claims includes any material or condition which is undesirably disposed on or at the surface of the article.

I claim:

1. A method of removing contaminants from the surface of a metallic article comprising the steps of:

providing abrasive particles comprised of coke; and directing said abrasive particles in impingement onto said contaminated surface thereby removing said contaminants therefrom.

2. The method as set forth in claim 1 wherein said abrasive particles have an erosivity within the range of 0.004 grams to 0.15 grams.

3. The method as set forth in claim 1 wherein said abrasive particles are comprised of a volatile matter content of less than 8% by weight.

4. The method as set forth in claim 1 wherein said abrasive particles are comprised of a carbon content within the range of 75% to 98% by weight.

5. The method as set forth in claim 4 wherein said abrasive particles are comprised of a volatile matter content within the range of 1% to 6% by weight.

6. The method as set forth in claim 1 further including the step of entraining said particles in a fluid flow stream and wherein said directing step includes the step of directing said fluid flow stream onto said contaminated surface.

7. The method as set forth in claim 1 wherein the size of at least some of said particles is sufficiently small to permit passage thereof through a Size 6 Sieve in the U.S. Standard Screen Scale.

8. The method as set forth in claim 1 wherein said abrasive coke particles are comprised of a carbon content of at least 70% by weight.

9. The method as set forth in claim 1 wherein said abrasive coke particles are comprised of by-product coke produced during the distillation of coal products.

10. The method as set forth in claim 1 wherein said abrasive coke particles are comprised of by-product coke produced during the distillation of petroleum products.

11. A method of removing contaminants from the internal components of a compressor associated with a gas turbine engine said method comprising the steps of:

providing abrasive particles having an erosivity within the range of 0.004 grams to 0.15 grams and further having a carbon content of at least 70% by weight; and directing said abrasive particles in impingement onto said contaminated internal components of said engine thereby removing said contaminants therefrom.

12. The methods as set forth in claim 11 wherein said abrasive particles are comprised of a volatile matter content of less than 8% by weight.

13. The method as set forth in claim 11 further including the step of entraining said particles in a fluid flow stream and wherein said directing step includes the step of directing said fluid flow stream onto said contaminated surface.

14. The method as set forth in claim 13 wherein said abrasive particles are comprised of a carbon content within the range of 75% to 98% by weight.

15. The method as set forth in claim 14 wherein said abrasive particles are comprised of a volatile matter content within the range of 1% to 6%.

16. The method as set forth in claim 15 wherein said abrasive particles are comprised of by-product coke produced during the distillation of coal.

17. A method of removing contaminants from the internal metallic components of an air-breathing machine having an air flow path adapted to provide for the passage of air through said machine with said contaminated internal metallic component disposed within said flow path, said method comprising:

entraining abrasive particles in a stream of air in said flow path upstream of said contaminated internal metallic components, said particles being comprised of coke; and directing said stream of air and said entrained particles in impingement upon said contaminated internal metallic components thereby removing said contaminants therefrom.

18. The method as set forth in claim 17 wherein said abrasive particles are further comprised of less than 8%, by weight of volatile matter.

19. The method as set forth in claim 17 wherein said abrasive particles have an erosivity within the range of 0.004 grams to 0.15 grams.

20. The method as set forth in claim 17 wherein said abrasive coke particles are comprised of a carbon content of at least 70% by weight.

21. A method of removing contaminants from the internal metallic components of a gas turbine engine having, disposed in a serial flow relationship in a fluid flow passage in said engine, an air inlet for admitting air to said engine, a rotatable compressor, a combustor, a rotatable turbine, and a hot gas exhaust, said method comprising:

entraining abrasive particles in a stream of air flowing in said passage upstream of said contaminated components, said particles comprised of coke; and directing said stream of air and said entrained particles in impingement upon said contaminated components thereby removing said contaminants therefrom.

22. The method as set forth in claim 21 wherein said abrasive particles are comprised of a material having a volatile matter content of less than 8%.

23. The method as set forth in claim 21 wherein said entraining step further comprises introducing said abrasive particles into said gas turbine engine through said inlet.

24. The method as set forth in claim 23 wherein said directing step includes directing said stream of air and said entrained particles in impingement upon contaminated blades and vanes associated with said compressor.

25. The method as set forth in claim 24 wherein said abrasive particles have an erosivity within the range of 0.004 grams to 0.15 grams.

26. The method as set forth in claim 25 wherein the size of said abrasive particles is sufficiently small to permit passage thereof through a Size 6 Sieve in the U.S. Standard Screen Scale.

27. The method as set forth in claim 21 werein said abrasive materials are comprised of a material having a carbon content within the range of 75% to 98% by weight.

28. The method as set forth in claim 27 wherein said abrasive materials are comprised of a material having a volatile matter content within the range of 1% to 8% by weight.

29. The method as set forth in claim 21 wherein said abrasive material will react with oxygen to form predominantly gaseous products of reaction when exposed to the heat generated in a hot section of said engine while said particles are residing in said hot section.

30. The method as set forth in claim 21 wherein said abrasive coke particles are comprised of a carbon content of at least 70% by weight.

31. The method as set forth in claim 21 wherein said abrasive coke particles are comprised of by-product coke produced during the distillation of coal products, said by-product coke being comprised of a carbon content of at least 80% by weight and a volatile matter content of less than 6% by weight.

32. The method as set forth in claim 21 wherein said abrasive coke particles are comprised of by-product coke produced during the distillation of petroleum products, said by-product coke being comprised of a carbon content of at least 80% by weight and a volatile matter content of less than 6% by weight.

33. A method of removing contaminants from the internal components of a compressor associated with a gas turbine engine said method comprising the steps of:

providing abrasive particles comprised of a material having a carbon content of at least 70% by weight an erosivity within the range of 0.004 grams to 0.15 grams and further having undergone a distillation-type process wherein at least some volatile matter has been removed therefrom; and directing said abrasive particles in inpingement upon said contaminated internal components of said engine thereby removing said contaminants therefrom.

34. The method of claim 33 wherein said abrasive particles have an erosivity within the range of 0.004 grams to 0.15 grams.

35. The method of claim 33 wherein said abrasive particles are comprised of a carbon content of at lease 70% by weight.

36. The method of claim 33 wherein said abrasive particles are comprised of a remaining volatile matter content within the range of 1% to 6% by weight.

37. The method of claim 33 wherein said material is by-product coke produced by the carbonization of coal.

* * * * *